US005925496A

United States Patent [19]

Ghosh et al.

[11] Patent Number: 5,925,496

[45] Date of Patent: Jul. 20, 1999

[54] ANODIZED ZIRCONIUM METAL LITHOGRAPHIC PRINTING MEMBER AND METHODS OF USE

[75] Inventors: Syamal K. Ghosh; Dilip K. Chatterjee, both of Rochester, N.Y.

[73] Assignee: Eastman Kodak Company, Rochester, N.Y.

[21] Appl. No.: 09/004,118

[22] Filed: Jan. 7, 1998

[51] Int. Cl.[6] ..... G03C 1/492; B41M 5/00

[52] U.S. Cl. ..... 430/270.1; 430/302; 430/945; 101/453; 101/467; 101/478

[58] Field of Search ..... 430/302, 945, 430/303, 270.1; 101/453, 467, 478

[56] References Cited

U.S. PATENT DOCUMENTS

| | | | |
|---|---|---|---|
| 3,506,779 | 4/1970 | Brown et al. | 178/6.6 |
| 3,549,733 | 12/1970 | Caddell | 264/25 |
| 3,574,657 | 4/1971 | Burnett | 117/8 |
| 3,654,864 | 4/1972 | Ovshinsky | 101/426 |
| 3,793,033 | 2/1974 | Mukherjee | 96/115 R |
| 3,832,948 | 9/1974 | Barker | 101/401.1 |
| 3,945,318 | 3/1976 | Landsman | 101/467 |
| 3,962,513 | 6/1976 | Eames | 428/323 |
| 3,964,389 | 6/1976 | Peterson | 101/467 |
| 4,034,183 | 7/1977 | Uhlig | 219/122 LM |
| 4,054,094 | 10/1977 | Caddell et al. | 101/467 |
| 4,081,572 | 3/1978 | Pacansky | 427/53 |
| 4,344,006 | 8/1982 | Kitajima et al. | 430/254 |
| 4,693,958 | 9/1987 | Schwartz et al. | 430/302 |
| 4,731,317 | 3/1988 | Fromson et al. | 430/159 |
| 4,794,680 | 1/1989 | Meyerhoff et al. | 29/132 |
| 4,846,065 | 7/1989 | Mayrhofer et al. | 101/453 |
| 4,967,663 | 11/1990 | Metcalf | 101/348 |
| 5,045,697 | 9/1991 | Schneider | 250/316.1 |
| 5,238,778 | 8/1993 | Hirai et al. | 430/200 |
| 5,345,869 | 9/1994 | Treverton et al. | 101/454 |
| 5,353,705 | 10/1994 | Lewis et al. | 101/453 |
| 5,378,580 | 1/1995 | Leenders | 430/303 |
| 5,385,092 | 1/1995 | Lewis et al. | 101/467 |
| 5,395,729 | 3/1995 | Reardon et al. | 430/200 |
| 5,454,318 | 10/1995 | Hirt et al. | 101/453 |
| 5,555,809 | 9/1996 | Hirt et al. | 101/451 |
| 5,868,074 | 2/1999 | Neifert et al. | 101/462 |

FOREIGN PATENT DOCUMENTS

| | | |
|---|---|---|
| 0 001 068 | 8/1977 | European Pat. Off. . |
| 0 531 878 | 9/1991 | European Pat. Off. . |
| 0 573 091 | 6/1992 | European Pat. Off. . |
| 0 693 371 | 7/1994 | European Pat. Off. . |
| 0 769 372 | 10/1995 | European Pat. Off. . |
| 44 42 235 | 12/1993 | Germany . |

*Primary Examiner*—Janet Baxter
*Assistant Examiner*—Rosemary Ashton
*Attorney, Agent, or Firm*—J. Lanny Tucker

[57] ABSTRACT

Long wearing and reusable lithographic printing members are prepared from a zirconium metal or alloy that has an anodized zirconium metal or alloy printing surface. In use, the anodized printing surface of the printing member is imagewise exposed to electromagnetic radiation which transforms it from a hydrophilic to an oleophilic state or from an oleophilic to a hydrophilic state, thereby creating a lithographic printing surface which is hydrophilic in non-image areas and is oleophilic and thus capable of accepting printing ink in image areas. Such inked areas can then be used to transfer an image to a suitable receiving material in lithographic printing. These printing members are directly laser-imageable as well as image erasable.

20 Claims, 1 Drawing Sheet

ANODIZED ZIRCONIUM METAL LITHOGRAPHIC PRINTING MEMBER AND METHODS OF USE

RELEVANT APPLICATIONS

Copending and commonly assigned U.S. Ser. No. 08/844,348, now U.S. Pat. No. 5,855,173 filed on Apr. 18, 1997, by Chatterjee et al, as a CIP of U.S. Ser. No. 08/576,178, now U.S. Pat. No. 5,743,188, filed Dec. 21, 1995.

Copending and commonly assigned U.S. Ser. No. 08/844,292, now U.S. Pat. No. 5,839,370 filed on Apr. 18, 1997, by Chatterjee et al.

Copending and commonly assigned U.S. Ser. No. 08/843,522, now U.S. Pat. No. 5,839,369 filed on Apr. 18, 1997, by Chatterjee et al.

Copending and commonly assigned U.S. Ser. No. 08/848,780, filed on May 1, 1997, by Ghosh et al.

Copending and commonly assigned U.S. Ser. No. 08/848,332, now U.S. Pat. No. 5,836,249 filed on May 1, 1997, by Chatterjee et al.

Copending and commonly assigned U.S. Ser. No. 08/850,315, now U.S. Pat. No. 5,826,248 filed on May 1, 1997, by Jarrold et al.

FIELD OF THE INVENTION

This invention relates in general to lithography and in particular to new and improved lithographic printing members. More specifically, this invention relates to novel printing members having a printing surface composed of an anodized zirconium metal or alloy, that are readily imaged and then useful for lithographic printing.

BACKGROUND OF THE INVENTION

The art of lithographic printing is based upon the immiscibility of oil and water, wherein the oily material or ink is preferentially retained by the image area and the water or fountain solution is preferentially retained by the non-image area. When a suitably prepared surface is moistened with water and an ink is then applied, the background or non-image area retains the water and repels the ink while the image area accepts the ink and repels the water. The ink on the image area is then transferred to the surface of a material upon which the image is to be reproduced, such as paper, cloth and the like. Commonly the ink is transferred to an intermediate material called the blanket, which in turn transfers the ink to the surface of the material upon which the image is to be reproduced.

Aluminum has been used for many years as a support for lithographic printing plates. In order to prepare the aluminum for such use, it is typical to subject it to both a graining process and a subsequent anodizing process. The graining process serves to improve the adhesion of the subsequently applied radiation-sensitive coating and to enhance the water-receptive characteristics of the background areas of the printing plate. The graining affects both the performance and the durability of the printing plate, and the quality of the graining is a critical factor determining the overall quality of the printing plate. A fine, uniform grain that is free of pits is essential to provide the highest quality performance.

Both mechanical and electrolytic graining processes are well known and widely used in the manufacture of lithographic printing plates. Optimum results are usually achieved through the use of electrolytic graining, which is also referred to in the art as electrochemical graining or electrochemical roughening, and there have been a great many different processes of electrolytic graining proposed for use in lithographic printing plate manufacturing. Processes of electrolytic graining are described in numerous references.

In the manufacture of lithographic printing plates, the graining process is typically followed by an anodizing process, utilizing an acid such as sulfuric or phosphoric acid, and the anodizing process is typically followed by a process that renders the surface hydrophilic such as a process of thermal silication or electrosilication. The anodization step serves to provide an anodic oxide layer and is preferably controlled to create a layer of at least 0.3 $g/m^2$. Processes for anodizing aluminum to form an anodic oxide coating and then hydrophilizing the anodized surface by techniques such as silication are very well known in the art, and need not be further described herein.

Illustrative of the many materials useful in forming hydrophilic barrier layers are polyvinyl phosphonic acid, polyacrylic acid, polyacrylamide, silicates, zirconates and titanates.

The result of subjecting aluminum to an anodization process is to form an oxide layer that is porous. Pore size can vary widely, depending on the conditions used in the anodization process, but is typically in the range of from about 0.1 to about 10 $\mu$m. The use of a hydrophilic barrier layer is optional but preferred. Whether or not a barrier layer is employed, the aluminum support is characterized by having a porous wear-resistant hydrophilic surface that specifically adapts it for use in lithographic printing, particularly in situations where long press runs are required.

A wide variety of radiation-sensitive materials suitable for forming images for use in the lithographic printing process are known. Any radiation-sensitive layer is suitable which, after exposure and any necessary developing and/or fixing, provides an area in imagewise distribution that can be used for printing.

Useful negative-working compositions include those containing diazo resins, photocrosslinkable polymers and photopolymerizable compositions. Useful positive-working compositions include aromatic diazooxide compounds such as benzoquinone diazides and naphthoquinone diazides.

Lithographic printing plates of the type described hereinabove are usually developed with a developing solution after being imagewise exposed. The developing solution, which is used to remove the non-image areas of the imaging layer and thereby reveal the underlying porous hydrophilic support, is typically an aqueous alkaline solution and frequently includes a substantial amount of organic solvent. The need to use and dispose of substantial quantities of alkaline developing solution has long been a matter of considerable concern in the printing art.

Efforts have been made for many years to manufacture a printing plate that does not require development with an alkaline developing solution. Examples of the many references relating to such prior efforts include, among others: U.S. Pat. No. 3,506,779 (Brown et al), U.S. Pat. No. 3,549,733 (Caddell), U.S. Pat. No. 3,574,657 (Burnett), U.S. 3,793,033 (Mukherjee), U.S. Pat. No. 3,832,948 (Barker), U.S. Pat. No. 3,945,318 (Landsman), U.S. Pat. No. 3,962,513 (Eames), U.S. Pat. No. 3,964,389 (Peterson), U.S. Pat. No. 4,034,183 (Uhlig), U.S. Pat. No. 4,054,094 (Caddell et al), U.S. Pat. No. 4,081,572 (Pacansky), U.S. Pat. No. 4,334,006 (Kitajima et al), U.S. Pat. No. 4,693,958 (Schwartz et al), U.S. Pat. No. 4,731,317 (Fromson et al), U.S. Pat. No. 5,238,778 (Hirai et al), U.S. Pat. No. 5,353,705

(Lewis et al), U.S. Pat. No. 5,385,092 (Lewis et al), U.S. Pat. No. 5,395,729 (Reardon et al), EP-A-0 001 068, and EP-A-0 573 091.

Lithographic printing plates designed to eliminate the need for a developing solution which have been proposed heretofore have suffered from one or more disadvantages that have limited their usefulness. For example, they have lacked a sufficient degree of discrimination between oleophilic image areas and hydrophilic non-image areas with the result that image quality on printing is poor, or they have had oleophilic image areas which are not sufficiently durable to permit long printing runs, or they have had hydrophilic non-image areas that are easily scratched and worn, or they have been unduly complex and costly by virtue of the need to coat multiple layers on the support.

The lithographic printing plates described hereinabove are employed in a process that employs both a printing ink and an aqueous fountain solution. Also well known in the lithographic printing art are so-called "waterless" printing plates that do not require the use of a fountain solution. Such plates have a lithographic printing surface comprised of oleophilic (ink-accepting) image areas and oleophobic (ink-repellent) background areas. They are typically comprised of a support, such as aluminum, a photosensitive or heat-sensitive layer that overlies the support, and an oleophilic silicone rubber layer that overlies that layer, and are subjected to the steps of imagewise exposure followed by development to form the lithographic printing surface.

Ceramic printing members, including printing cylinders are known. US-A-5,293,817 (Nüssel et al), for example, describes porous ceramic printing cylinders having a printing surface prepared from zirconium oxide, aluminum oxide, aluminum-magnesium silicate, magnesium silicate or silicon carbide.

It has also been discovered that ceramic alloys of zirconium oxide and a secondary oxide that is MgO, CaO, $Y_2O_3$, $Sc_2O_3$ or a rare earth oxide are highly useful printing members, as described for example, in EP-A-0 769 372.

While such printing members are highly useful with a number of advantages over conventional materials, there is a need to provide ceramic printing members having greater strength, fracture resistance and wearability, and that are more lightweight.

SUMMARY OF THE INVENTION

This invention provides a lithographic printing member having a printing surface composed of an anodized zirconium metal or alloy layer, the anodized layer having a density of from about 5.0 to about 5.8 g/cm$^3$.

This invention also provides a method of imaging comprising the steps of:

A) providing the lithographic printing member described above, and

B) providing an image on the printing surface by imagewise exposing the printing surface to electromagnetic radiation provided by a laser so as to transform the printing surface from a hydrophilic to an oleophilic state or from an oleophilic to a hydrophilic state in the exposed areas of the printing surface, thereby creating a lithographic printing surface having both image areas and non-image areas.

Further, this invention also provides a method of lithographic printing comprising the steps of:

A) providing the lithographic printing member described above,

B) providing an image on the printing member as described above,

C) contacting the lithographic printing surface with a lithographic printing ink, thereby forming an inked lithographic printing surface, and D) contacting the inked lithographic printing surface with a receiving material to thereby transfer the printing ink to the receiving material in an imagewise fashion.

Such methods can additionally be continued by cleaning the ink off the printing surface, erasing the image thereon and reimaging the printing member, as described in more detail below. In such fashion, the invention can be used to provide a reusable lithographic printing member.

The printing members of this invention have a number of advantages. For example, no chemical processing is required so that the effort, expense and environmental concerns associated with the use of aqueous alkaline developing solutions are avoided. Post-exposure baking or blanket exposure to ultraviolet or visible light sources, as are commonly employed with many lithographic printing plates, are not required. Imagewise exposure of the printing member can be carried out directly with a focused laser beam that converts the anodized zirconium metal (or alloy) printing surface from a hydrophilic to an oleophilic state or from an oleophilic to a hydrophilic state. Exposure with a laser beam enables the printing member to be imaged directly from digital data, and used in printing, without the need for intermediate films and conventional time-consuming optical printing methods. Since no chemical processing, wiping, brushing, baking or treatment of any kind is required, it is feasible to expose the printing member directly on the printing press by equipping the press with a laser exposing device and suitable means for controlling the position of the laser exposing device.

A still further advantage is that the printing member is well adapted to function with conventional fountain solutions and/or conventional lithographic printing inks so that no novel or costly chemical compositions are required. The printing members of this invention are also designed to be "erasable" as described below. That is, the images can be erased and the printing members reused.

The anodized zirconium metal or alloy utilized in this invention has many characteristics that render it especially beneficial for use in lithographic printing. Thus, for example, the anodized zirconium metal or alloy surface is extremely durable, abrasion-resistant, and long wearing. Lithographic printing members having such a printing surface are capable of producing a virtually unlimited number of copies, for example, press runs of up to several million. On the other hand, since very little effort is required to prepare the printing member for printing, it is also well suited for use in very short press runs for the same or different images. Discrimination between oleophilic image areas and hydrophilic non-image areas is excellent. The printing member can be of several different forms (described below) and thus can be flexible, semi-rigid or rigid. Its use is fast and easy to carry out, image resolution is very high and imaging is especially well suited to images that are electronically captured and digitally stored.

The lithographic printing members of this invention exhibit exceptional durability, abrasion resistance, and long-wearing characteristics that exceed those of the conventional printing plates. In addition, they have greater wearability and higher strength and fracture resistance (or toughness) over monolithic zirconia ceramic printing members.

Still another advantage of lithographic printing members prepared from anodized zirconium metal or alloys as described herein is that, unlike conventional lithographic printing plates, they are erasable and reusable. Thus, for example, after the printing ink has been removed from the printing surface using known devices and procedures, the oleophilic image areas of the printing surface can be erased by thermally-activated oxidation or by laser-assisted oxidation. Accordingly, the printing member can be imaged, erased and re-imaged repeatedly.

DETAILED DESCRIPTION OF THE INVENTION

Figure 1:
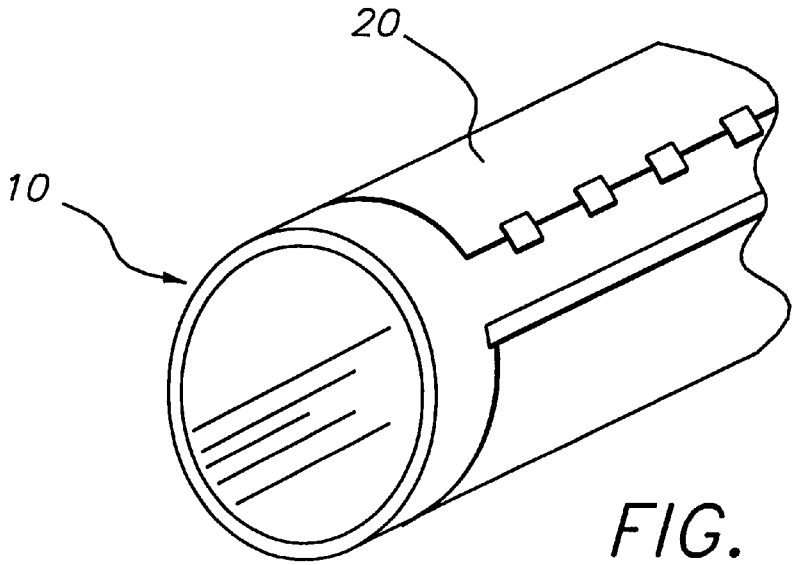
FIG. 1 is a highly schematic fragmentary isometric view of a printing member of this invention, that is composed of an anodized zirconium metal or alloy printing member wrapped around a conventional printing drum.

In one embodiment of this invention, the lithographic printing member comprises a zirconium metal or alloy, having an anodized surface layer that is hydrophilic anodized zirconium metal or alloy of stoichiometric ($ZrO_2$) composition. Imagewise exposure (with electromagnetic irradiation) of that surface layer converts it to an oleophilic substoichiometric ($ZrO_{2-x}$) composition in the exposed regions (image areas), leaving non-exposed (background) areas hydrophilic.

In an alternative embodiment of the invention, the lithographic printing member comprises an oleophilic anodized zirconium metal or alloy surface of substoichiometric composition, and imagewise exposure (with electromagnetic irradiation, usually with either visible or infrared irradiation) converts it to a hydrophilic stoichiometric composition in the exposed regions. In this instance, the exposed regions serve as the background (or non-image areas) and the unexposed regions serve as the image areas.

The hydrophilic anodized zirconium metal or alloy thus comprises the stoichiometric oxide, for example $ZrO_2$, while the oleophilic anodized zirconium metal or alloy comprises a substoichiometric oxide, for example $ZrO_{2-x}$. The change from a stoichiometric to a substoichiometric composition is achieved by reduction while the change from a substoichiometric composition to a stoichiometric composition is achieved by oxidation.

The lithographic printing member is comprised entirely of, or has as a portion thereof, zirconium metal or alloy, and has an anodized zirconium metal or anodized zirconium alloy printing surface layer. In some embodiments, the zirconium metal is alloyed with one or more of aluminum, titanium, nickel or other metals known in the art to be useful in this purpose, that can be oxidized during anodization. These additional metals may improve the anodization process, or the imaging capabilities of the printing member. A preferred additional metal is aluminum. Thus, upon anodization, the surface can be composed of alloys of zirconium oxide and one or more of aluminum oxide, titanium oxide, nickel oxide, and the like. Below the surface layer, however, remains the pure zirconium metal, or alloys of zirconium with one or more of the other metals. When alloys are used, zirconium is present in an amount of at least 90 weight %, and preferably at least 95 weight %, the remainder being one or more of the other metals.

Thus, the printing surface of the printing member is composed of a thin film or layer of anodized zirconium metal or zirconium alloy of metals. The thickness of this layer can vary from one region to another of the printing member, but in general, the average thickness of the anodized layer is at least 0.1, and preferably at least 1 $\mu$m, and generally less than 15 and preferably less than 10 $\mu$m. Each type of printing member may have a different optimum thickness of the anodized printing surface layer.

Anodizing is accomplished by passing direct current at sufficient voltage through a suitable electrolyte in which the zirconium metal or alloy to be anodized is the anode and a suitable conductive material (such as graphite, copper, aluminum or silver) is the cathode. Graphite is preferred. The procedure is described by Brace and Sheasby, *The Technology of Anodizing Aluminum*, Technicopy Limited, England, 2nd Edition, 1968. Various electrolytes can be used, including sulfuric acid (15–20 weight %), phosphoric acid and a suitable hydroxide. Sulfuric acid is preferred. It is common practice to agitate the electrolyte bath, for example, by passing air through the bath at a desired rate.

The anodizing voltage is generally from about 8 to about 50 volts (d.c.), and the current density ranges from about 10 to about 30 amperes/ft$^2$ (108 to 325 amperes/m$^2$). Anodizing voltage, current density and the electrolyte temperature influence the rate of anodized coating thickness growth. Increasing anodizing time by keeping the voltage, current density and bath temperature constant increases the coating thickness. Generally, the anodizing time is from about 10 to about 60 minutes. It was observed that for a given anodizing voltage and current density, the coating thickness remained almost constant after 30 minutes.

The anodized zirconium metal or alloy utilized in this invention can be effectively converted from a hydrophilic to an oleophilic state during imaging by exposure to infrared radiation at a wavelength of about 1064 nm (or 1.064 $\mu$m). Radiation of this wavelength serves to convert a stoichiometric zirconium oxide (or alloy of oxides) that is strongly hydrophilic, to a substoichiometric zirconium oxide (or alloy of oxides) that is strongly oleophilic by promoting a reduction reaction. The use for this purpose of Nd:YAG lasers that emit at 1064 nm is especially preferred.

Conversion from an oleophilic to a hydrophilic state can be effectively achieved by exposure to visible radiation with a wavelength of 488 nm (or 0.488 $\mu$m). Radiation of this wavelength serves to convert the oleophilic substoichiometric zirconium oxide (or alloy of oxides) to the hydrophilic stoichiometric zirconium oxide (or alloy of oxides) by promoting an oxidation reaction. Argon lasers that emit at 488 nm are especially preferred for this purpose, but carbon dioxide lasers irradiating in the infrared (such as 10600 nm or 10.6 $\mu$m) are also useful.

While heating substoichiometric anodized zirconium metal film at from about 150 to about 250° C. can also convert the zirconium oxide film to a stoichiometric state, the zirconium oxide can be similarly converted at a higher temperature, for example from about 300 to about 500° C.

The printing members of this invention can be of any useful form including, but not limited to, printing plates, printing cylinders, printing sleeves, and printing tapes (including flexible printing webs).

Printing plates can be of any useful size and shape (for example, square or rectangular), and can be composed of zirconium metal or alloy throughout (monolithic), or have a layer of the metal or alloy disposed on a suitable metal or polymeric substrate (with one or more optional intermediate layers).

Printing cylinders and sleeves are described, for example, in the application, U.S. Ser. No. 08/844,348 now U.S. Pat.

No. 5,855,173 of Chatteijee, Ghosh and Nüssel. Such rotary printing members can be composed of the noted zirconium metal or alloy throughout, or the printing cylinder or sleeve can have the metal or alloy only as an outer layer on a substrate (with this outer layer having a thin outermost layer of anodized metal). Hollow or solid steel or aluminum cores can be used as substrates if desired. Such printing members can be prepared using methods described above for the printing plates, as monolithic members or fitted around another less expensive metal core.

The anodized layer of zirconium metal or alloys useful in preparing printing tapes of this invention have a little more porosity, that is generally up to about 2%, and preferably from about 0.2 to about 2%. The density of the anodized metal layer is generally from about 5 to about 5.8 g/cm$^3$, and preferably from about 5 to about 5.2 g/cm$^3$ (for the preferred zirconium-aluminum alloy).

The anodized zirconium printing tapes have an average thickness of from about 0.1 to about 5 mm, and preferably from about 0.5 to about 3 mm. A thickness of about 1 mm provides optimum flexibility and strength. The printing tapes can be formed either on a rigid or semi-rigid substrate to form a composite with the anodized zirconium metal or alloy providing a printing surface, or they can be in monolithic form.

The printing tapes of this invention, in the form of a continuous web, enable a user to use different segments of the tape for different images. The tape would therefore provide continuity within the "same printing job" even if the images differed. The user need not interrupt the work to change conventional printing plates in order to provide different printed images.

The printing members of this invention can have a printing surface that is highly polished (as described below), or be textured using any conventional texturing method (chemical or mechanical). Porosity of the printing members can be varied in a number of ways to enhance water distribution in printing, and to increase flexibility of the printing member where needed.

The printing surface of the anodized zirconium metal or alloy can be thermally or mechanically polished, or it can be used in the anodized form, as described above. Preferably, the printing surface is polished to an average roughness of less than about 0.1 $\mu$m.

In one embodiment of this invention, a printing member is a solid or monolithic printing cylinder composed partially or wholly of the noted anodized zirconium metal or alloy. If partially composed of the zirconium metal or alloy, at least the outer surface is anodized.

Another embodiment is a rotary printing cylinder having a metal core on which an anodized zirconium metal or alloy layer or shell has been disposed or coated in a suitable manner to provide an outer anodized printing surface. Alternatively, the zirconium metal or alloy layer or shell can be a hollow, cylinder printing sleeve or jacket that is fitted around a metal core. The cores of such printing members are generally composed of one or more metals, such as ferrous metals (iron or steel), nickel, brass, copper or magnesium. Steel cores are preferred. The metal cores can be hollow or solid throughout, or be comprised of more than one type of metal. The anodized zirconium metal or alloy layers disposed on the noted cores generally have a uniform thickness of from about 1 to about 10 mm.

Still another embodiment is a hollow cylindrical zirconium metal sleeve that is composed entirely of the metal and has outer anodized metal printing surface. Such sleeves can have a thickness within a wide range, but for most practical purposes, the thickness is from about 1 to about 10 cm.

FIG. 1 shows a conventional printing drum or cylinder 10 around which is wrapped a printing plate 20 of this invention that is composed of a zirconium metal, the outer printing surface of which is a thin film of anodized zirconium metal, or zirconium alloy.

Figure 2:
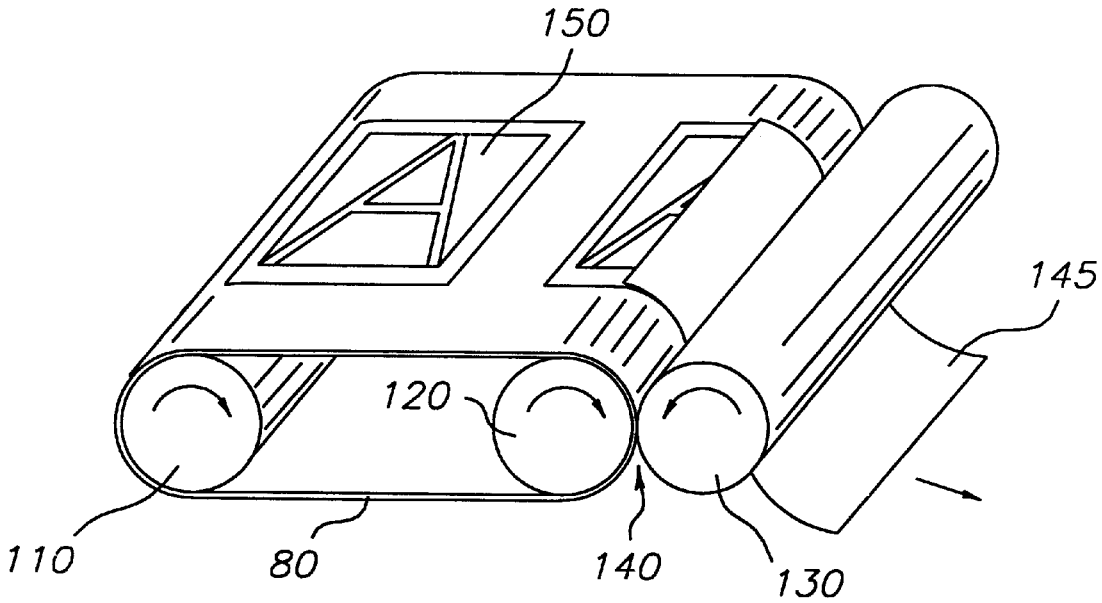
FIG. 2 is a highly schematic isometric partial view of a printing member of this invention that is composed of a printing tape or web of an anodized zirconium metal or alloy.

A printing tape of this invention is an elongated web of zirconium metal that has an anodized printing surface, and a defined thickness (as described above). Such a web can be mounted on a suitable image setting machine or printing press, usually as supported by two or more rollers for use in imaging and/or printing. Thus, in a very simplified fashion, FIG. 2 schematically shows printing tape 80 supported by drive rollers 110 and 120. Drive roller 120 and backing roller 130 provide nip 140 through which paper sheet 145 or another printable receiving material is passed after receiving the inked image 150 from tape 80. Such printing machines can also include laser imaging stations, inking stations, "erasing" stations, and other stations and components commonly used in lithographic printing.

The lithographic printing members of this invention can be imaged by any suitable technique on any suitable equipment, such as a plate setter or printing press. In one embodiment, the essential requirement is imagewise exposure to radiation which is effective to convert the hydrophilic anodized zirconium metal or alloy to an oleophilic state or to convert the oleophilic anodized zirconium metal or alloy to a hydrophilic state. Thus, the printing members can be imaged by exposure through a transparency or can be exposed from digital information such as by the use of a laser beam. Preferably, the printing members are directly laser written. The laser, equipped with a suitable control system, can be used to "write the image" or to "write the background."

Zirconium oxide coatings of stoichiometric composition are produced when zirconium metal is anodized as described above. Zirconium oxide coatings of substoichiometric composition can be produced when the anodized zirconium is heated in an inert or reducing atmosphere, or by exposing it to electromagnetic irradiation.

The anodized zirconium or zirconium alloy comprising stoichiometric zirconium metal, are off-white in color and strongly hydrophilic. The action of the laser beam transforms the off-white oxide film to black substoichiometric oxide film that is strongly oleophilic. The off-white and black compositions exhibit different surface energies, thus enabling one region to be hydrophilic and the other oleophilic. The imaging of the printing surface is due to photo-assisted reduction while image erasure is due either to thermally-assisted reoxidation or to photo-assisted thermal reoxidation.

For imaging the anodized printing surface, it is preferred to utilize a high-intensity laser beam with a power density at the printing surface of from about $30\times10^6$ to about $850\times10^6$ watts/cm$^2$ and more preferably from about $75\times10^6$ to about $425\times10^6$ watts/cm$^2$. However, any suitable exposure to electromagnetic radiation of an appropriate wavelength can be used.

An especially preferred laser for use in imaging the lithographic printing member of this invention is an Nd:YAG laser that is Q-switched and optically pumped with a krypton arc lamp. The wavelength of such a laser is 1.064 $\mu$m.

In one method of laser imaging, the conditions of laser exposure are controlled to provide localized "melting" of the exposed regions in the anodized metal oxide layer. Thus, these conditions of laser imaging effectively melt the anodized printing surface in exposed regions. The laser imaging conditions for this method are described below.

In another method of laser imaging, the conditions of laser exposure are controlled to "ablate", burn away or loosen a portion of the metal oxide layer in the exposed regions of the anodized printing surface. Thus, if the oxide layer is thick enough, a pit is formed in the exposed regions from the removal of "ablated" oxide layer. The bottom surface of the "pits" may actually comprise at least partially "melted" unanodized zirconium metal or alloy. If the oxide layer is very thin, the ablation may remove it in the exposed regions down to an underlying substrate (for example, to bare zirconium metal or alloy). However, this situation is avoided by proper choice of oxide layer thickness and laser irradiation conditions. The laser imaging conditions for these methods are described below.

For use in the hydrophilic to oleophilic conversion process by means of ablation, the following parameters are characteristic of a laser system that is especially useful.

Laser Power: Continuous wave average—0.1 to 50 watts, preferably from 0.5 to 30 watts, Peak power (Q-switched)—6,000 to $10^5$ watts, preferably from 6,000 to 70,000 watts, Power density—$30\times10^6$ to $850\times10^6$ W/cm$^2$, preferably from $75\times10^6$ to $425\times10^6$ W/cm$^2$, Spot size in $TEM_{00}$ mode=100 $\mu$m, Current=15 to 24 amperes, preferably from 18 to 24 amperes, Laser energy=$6\times10^{-4}$ to $5.5\times10^{-3}$ J, preferably from $6\times10^{-4}$ to $3\times10^{-3}$ J, Energy density=5 to 65 J/cm$^2$, preferably from 7 to 40 J/cm$^2$, Pulse Rate=0.5 to 50 kHz, preferably from 1 to 30 kHz, Pulse Width=50 to 300 nsec, preferably from 80 to 150 nsec, Scan Field=11.5×11.5 cm, Scan Velocity=up to 3 m/sec, Repeatability in pulse to pulse jitter=about 25% at high Q-switch rate (about 30 kHz), <10% at low Q-switch rate (about 1 kHz).

For imaging by means of "melting", essentially the laser set up conditions are basically the same as that of the ablation conditions noted above, however whether the laser will operate in the ablation mode or in the melting mode will be determined by the dot frequency in a given scan area. It is also characterized by very low Q-switch rate (<1 kHz), slow writing speed (scan velocity of 30 to 1000 mm/sec) and wide pulse width (50 to 500 $\mu$sec).

The laser images can be easily erased from the anodized zirconium metal or alloy printing surface. The printing member is cleaned of printing ink in any suitable manner using known cleaning devices and procedures, and then the image is erased by either heating the surface in air or oxygen at an elevated temperature (temperatures of from about 300 to about 500° C. for a period of about 5 to about 60 minutes are generally suitable with a temperature of about 400° C. for a period of about 10 minutes being preferred) or by treating the surface with a $CO_2$ laser operating in accordance with the following parameters:

Wave length: 10.6 $\mu$m

Peak Power: 300 watts (operated at 20% duty cycle)

Average Power: 70 watts

Beam Size: 500 $\mu$m with the beam width being pulse modulated.

In addition to its use as a means for erasing the image, a $CO_2$ laser can be employed as a means of carrying out the imagewise exposure in the process employing an oleophilic to hydrophilic conversion.

Only the anodized printing surface of the zirconium metal or alloy is altered in the image-forming process. However, the image formed is a permanent image which can only be removed by means such as the thermally-activated or laser-assisted oxidation described herein.

Upon completion of a printing run, the printing surface of the printing member can be cleaned of ink in any suitable manner and then the image can be erased and the plate can be re-imaged and used again. This sequence of steps can be repeated many times as the printing member is extremely durable and long wearing.

In the examples provided below, the images were captured electronically with a digital flat bed scanner or a Kodak Photo CD. The captured images were converted to the appropriate dot density, in the range of from about 80 to about 250 dots/cm. These images were then reduced to two colors by dithering to half tones. A raster to vector conversion operation was then executed on the half-toned images. The converted vector files in the form of plot files were saved and were laser scanned onto the anodized printing surface. The marking system accepts only vector coordinate instructions and these instructions are fed in the form of a plot file. The plot files are loaded directly into the scanner drive electronics. The electronically stored photographic images can be converted to a vector format using a number of commercially available software packages such as COREL DRIVE or ENVISION-IT by Envision Solutions Technology.

The invention is further illustrated by the following examples of various useful printing members.

EXAMPLE 1

An anodized zirconium printing plate of this invention was prepared by anodizing a sheet of zirconium metal in a 15% sulfuric acid bath wherein zirconium metal was used as the anode and graphite was used as the cathode. Anodization was carried out using 10 volts d.c. for 10 minutes. The voltage was ramped up after 1 minute, and the electrolyte was not agitated. The resulting oxide film on the zirconium metal sheets was about one $\mu$m in thickness.

EXAMPLE 2

The procedure described in Example 1 was repeated except that the voltage used during anodization was 30 volts d.c. The resulting oxide film on the zirconium metal sheets was about 2 $\mu$m in thickness.

EXAMPLE 3

The procedure of Example 2 was repeated except that the anodization time was 20 minutes. The resulting oxide film on the zirconium metal sheets was about 3 $\mu$m in thickness.

EXAMPLE 4

The printing plate described in Example 1, having an off-white hydrophilic anodized zirconium metal printing surface was imaged by irradiation with a Nd:YAG laser that was Q-switched and optically pumped with a krypton arc lamp. The spot size or beam diameter was about 100 $\mu$m in TEM (low order mode).

EXAMPLE 5

The imaged printing plate described in Example 4 was used for printing the image in the following manner. The imaged printing surface was cleaned with a fountain solution prepared from Mitsubishi SLM-OD fountain concentrate, diluted with water and isopropyl alcohol. Excess fluid was wiped off using a lint-free cotton pad. An oil based lithographic printing ink, Itek Mega Offset Ink, was then applied to the printing surface using a hand-held roller. The ink adhered to the imaged areas only. The ink image was then transferred to plain paper by placing the paper sheets over the printing plate and applying pressure to the sheets.

EXAMPLE 6

The printing plate used in Example 5 above was cleaned of printing ink, its image erased, and reused in the following manner. After cleaning off the printing ink using isopropyl alcohol, the printing plate was exposed to high heat (about 400° C.) to "erase" the image on the printing surface. The printing plate was then reimaged, reinked and used for printing as described in Examples 4 and 5 above.

The invention has been described in detail with particular reference to preferred embodiments thereof, but it will be understood that variations and modifications can be effected within the spirit and scope of the invention.

We claim:

1. A lithographic printing member having a printing surface composed of an anodized zirconium metal or alloy layer, said anodized layer having a density of from about 5.0 to 5.8 g/cm$^3$.

2. The printing member of claim 1 wherein said printing surface is composed of solely anodized zirconium metal.

3. The printing member of claim 1 wherein said printing surface is composed of an anodized alloy of zirconium and at least one other metal that is aluminum, titanium or nickel.

4. The printing member of claim 3 wherein the amount of zirconium metal in said alloy is at least 90 weight %.

5. The printing member of claim 4 wherein the amount of zirconium metal in said alloy is at least 95 weight %.

6. The printing member of claim 3 wherein said alloy is composed of zirconium oxide and aluminum oxide.

7. The printing member of claim 1 that is a printing plate, printing cylinder or a printing sleeve.

8. The printing member of claim 1 that is a printing tape.

9. The printing member of claim 1 wherein said anodized zirconium metal or alloy is composed of a hydrophilic stoichiometric anodized zirconium metal or alloy film.

10. The printing member of claim 1 wherein said anodized zirconium metal or alloy is composed of an oleophilic substoichiometric anodized zirconium metal or alloy film.

11. The printing member of claim 1 having an anodized zirconium metal or alloy printing surface that has been thermally or mechanically polished.

12. The printing member of claim 1 that is a lithographic printing plate having a non-zirconium substrate having thereon an anodized zirconium metal or alloy printing surface.

13. The printing member of claim 1 comprised entirely of a zirconium metal or alloy having an anodized zirconium metal or alloy printing surface layer.

14. The printing member of claim 13 wherein said anodized printing surface layer is up to 15 $\mu$m in thickness.

15. The printing member of claim 1 prepared by passing an oxidizing electrical current through an electrochemical cell having a cathode, anode and electrolyte, said anode being a zirconium metal or alloy.

16. A method of imaging comprising:

A) providing a lithographic printing member having a printing surface composed of an anodized zirconium metal or alloy layer, said anodized layer having a density of from about 5.0 to 5.8 g/cm$^3$, and B) exposing said printing member to a laser imaging device to provide an image on said printing surface.

17. The method of claim 16 wherein said image is provided on said printing surface by ablating the imaged regions on said printing surface using laser imaging under the following conditions:

an average power level of from about 0.1 to about 50 watts, a peak power of from about 6,000 to about 100,000 watts (in Q-switched mode), a pulse rate up to 50 kHz, an average pulse width of from about 50 to about 300 nsec, and a scan velocity of from about 3 m/sec.

18. The method of claim 16 wherein said image is provided on said printing surface by localized melting of the exposed regions on said printing surface using laser imaging under the following conditions:

an average power level of from about 0.1 to about 50 watts, a peak power of from about 6,000 to about 100,000 watts (in Q-switched mode), a pulse rate up to 50 kHz, an average pulse width of from about 50 to about 500 $\mu$sec, and a scan velocity of from about 30 to about 1000 mm/sec.

19. A method of printing comprising:

A) providing a lithographic printing member having a printing surface composed of an anodized zirconium metal or alloy layer, said anodized layer having a density of from about 5.0 to 5.8 g/cm$^3$, B) exposing said printing member to a laser imaging device to provide a image on said printing surface, C) applying a lithographic printing ink to said imaged printing surface, and D) transferring said printing ink to a receiving material.

20. The method of claim 19 wherein the ink is cleaned off said printing surface, and the image is erased by heating said printing surface at from about 300 to about 500° C. for up to about 60 minutes, or exposing said cleaned printing surface to a carbon dioxide laser emitting at a wavelength of about 10.6 $\mu$m or to an argon laser emitting at a wavelength of about 0.488 $\mu$m.

* * * * *